US009675186B2

(12) United States Patent
McGowan

(10) Patent No.: US 9,675,186 B2
(45) Date of Patent: Jun. 13, 2017

(54) MERCHANDISER INCLUDING VENTING FRAME FOR TOP CONTAINERS

(75) Inventor: Andrew R. McGowan, Claremont, CA (US)

(73) Assignee: Hussmann Corporation, Bridgeton, MO (US)

( * ) Notice: Subject to any disclaimer, the term of this patent is extended or adjusted under 35 U.S.C. 154(b) by 1895 days.

(21) Appl. No.: 12/873,001

(22) Filed: Aug. 31, 2010

(65) Prior Publication Data

US 2012/0047933 A1 Mar. 1, 2012

(51) Int. Cl.
*A47F 3/04* (2006.01)
*F25D 23/12* (2006.01)

(52) U.S. Cl.
CPC ..... *A47F 3/0456* (2013.01)

(58) Field of Classification Search
CPC ..... A47F 3/04; A47F 3/304; A47F 3/0408; A47F 3/0413; A47F 3/0417; A47F 3/0426; A47F 3/0439; A47F 3/0443; A47F 3/0447; A47F 3/0452; A47F 3/0456; A47F 2003/046; A47F 2003/0473; F25D 17/06; F25D 17/065; F25D 17/08; F25D 17/04; F25D 23/00; F25D 23/12; B65D 1/34
USPC ..... 62/258, 248, 255, 246, 252, 254, 251; 206/557, 515; 312/116; 220/575
See application file for complete search history.

(56) References Cited

U.S. PATENT DOCUMENTS 3,882,653 A 5/1975 Ollman
4,019,339 A 4/1977 Anderson
4,285,204 A 8/1981 Vana
4,397,159 A 8/1983 Dodd
4,457,140 A 7/1984 Rastelli
RE31,909 E 6/1985 Ibrahim
4,576,293 A 3/1986 Hinton
4,831,841 A 5/1989 Falk
4,922,079 A 5/1990 Bowen et al.
5,168,719 A * 12/1992 Branz et al. ..... 62/258
5,381,672 A 1/1995 Haasis
5,477,702 A * 12/1995 Kennedy et al. ..... 62/256
(Continued)

FOREIGN PATENT DOCUMENTS

BE 1009980 4/1997
EP 0098686 1/1984
(Continued)

*Primary Examiner* — Jianying Atkisson
*Assistant Examiner* — Harry Arant
(74) *Attorney, Agent, or Firm* — Michael Best & Friedrich LLP

(57) ABSTRACT

A pan apparatus for a merchandiser including a case having a platform defining an opening. The pan apparatus includes a bottom wall and a plurality of sidewalls cooperating with the bottom wall to define a space for supporting product in the pan. At least two of the sidewalls each includes a frame engagement member adjacent a top of the pan. The pan apparatus also includes a frame positioned adjacent a top of the sidewalls and coupled to the frame engagement members. The frame extends along at least two sidewalls of the pan and is configured to engage the platform adjacent the opening to suspend the pan. The frame defines a plurality of holes spaced along at least a portion of the perimeter such that an airflow from below the pan is directed upward along the sidewalls and discharged through the frame via the holes to condition the product.

14 Claims, 7 Drawing Sheets

(56) References Cited

U.S. PATENT DOCUMENTS

| | | | | |
|---|---|---|---|---|
| 6,089,036 | A | 7/2000 | Carlson et al. | |
| 6,151,905 | A | 11/2000 | Smith | |
| 6,237,350 | B1 | 5/2001 | Hertel | |
| 6,237,775 | B1 | 5/2001 | Hatch et al. | |
| 6,298,672 | B1 | 10/2001 | Valicoff, Jr. | |
| 6,385,990 | B1 * | 5/2002 | Lee | 62/407 |
| 6,539,740 | B1 | 4/2003 | Santana, Jr. | |
| 6,612,124 | B1 | 9/2003 | Hatch et al. | |
| 7,243,506 | B2 | 7/2007 | Spillner | |
| 7,313,927 | B2 | 1/2008 | Barker | |
| 7,497,770 | B2 | 3/2009 | Grassmuck et al. | |
| 2002/0072323 | A1 | 6/2002 | Hakemann | |
| 2002/0162347 | A1 | 11/2002 | Walker et al. | |
| 2004/0083749 | A1 | 5/2004 | Weikel et al. | |
| 2004/0200231 | A1 | 10/2004 | Seiss | |
| 2005/0210884 | A1 | 9/2005 | Tuskiewicz et al. | |
| 2007/0130986 | A1 | 6/2007 | Kinser | |
| 2009/0013707 | A1 | 1/2009 | Spillner | |

FOREIGN PATENT DOCUMENTS

| | | |
|---|---|---|
| FR | 2829568 | 3/2003 |
| WO | 2008084914 | 7/2008 |

* cited by examiner

MERCHANDISER INCLUDING VENTING FRAME FOR TOP CONTAINERS

BACKGROUND

The present invention relates to a merchandiser including a product display area, and more particularly, to a merchandiser including a pan for supporting product.

In conventional practice, supermarkets and convenience stores are equipped with merchandisers that have open and/or closed display portions for presenting fresh food, beverages, and other food product in a product display area to customers while maintaining the food product in a conditioned environment. Some existing merchandisers include open-top pans that support condiments or other similar food product. Typically, a cooled airflow is directed over the top of the pans as an "air sweep" to keep ambient heat load from infiltrating into the pans. In other existing merchandisers, a cooled airflow is directed below the pans to remove the heat load via the bottom of each pan. In these merchandisers, the airflow is often vented out the front of the case.

SUMMARY

In one construction, the invention provides a pan apparatus for a merchandiser including a case having a platform defining an opening. The pan apparatus includes a bottom wall and a plurality of sidewalls cooperating with the bottom wall to define a space for supporting product in the pan. At least two of the sidewalls each includes a frame engagement member adjacent a top of the pan. The pan apparatus also includes a frame positioned adjacent a top of the sidewalls and coupled to the frame engagement members. The frame extends along at least two sidewalls of the pan and is configured to engage the platform adjacent the opening to suspend the pan. The frame has a perimeter and defines a plurality of holes spaced along at least a portion of the perimeter such that an airflow from below the pan is directed upward along the sidewalls and discharged through the frame via the holes to condition the product.

In another construction, the invention provides a merchandiser including a case that defines a product display area, a lower passageway in fluid communication with the product display area, and a rear passageway in fluid communication with the lower passageway. The case has a base and a platform that is positioned above the base. The platform defines an opening accessible from adjacent a top of the case. The merchandiser also includes a pan and a frame. The pan is suspended from the platform within the opening. The pan is defined by a plurality of sidewalls and a bottom wall that cooperates with the sidewalls to define a space for supporting product therein. The frame is coupled to the platform adjacent a periphery of the opening, and the frame is further coupled to the pan adjacent a top of at least two sidewalls to support the pan within the opening. The frame includes a perimeter and defines a plurality of holes spaced along the perimeter such that an airflow from the rear passageway is at least partially directed upward along the sidewalls and discharged through the holes adjacent the top of the pan to condition the product.

In yet another construction, the invention provides a merchandiser including a case that defines a product display area, a lower passageway in fluid communication with the product display area, a rear passageway in fluid communication with the lower passageway, and an upper passageway in fluid communication with the rear passageway and the product display area. The case has a base and a platform positioned above the base. The platform defines an opening accessible from adjacent a top of the case. The merchandiser also includes a pan coupled to the platform within the opening, a frame coupled to the platform adjacent a periphery of the opening, and a dividing wall. The pan is defined by a plurality of sidewalls and a bottom wall that cooperates with the sidewalls to define a space for supporting product therein. The frame is further coupled to the pan adjacent a top of at least two of the sidewalls to support the pan within the opening. The frame includes a perimeter and defines a plurality of holes spaced along at least a portion of the perimeter. The dividing wall is coupled to the case adjacent the platform to separate the upper passageway from the pan. The dividing wall includes at least one aperture in fluid communication with one of the rear passageway and the upper passageway, and the dividing wall, the pan, and the frame cooperate to define an airflow passageway that is defined along the sidewalls of the pan and in fluid communication with the holes. The merchandiser further includes an airflow generation device coupled to the case within at least one of the lower passageway, the rear passageway, and the upper passageway to direct an airflow through the lower passageway, the rear passageway, and the upper passageway toward the product display area. At least a portion of the airflow from the airflow generation device is configured to flow through the airflow passageway and through the holes to condition the product.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
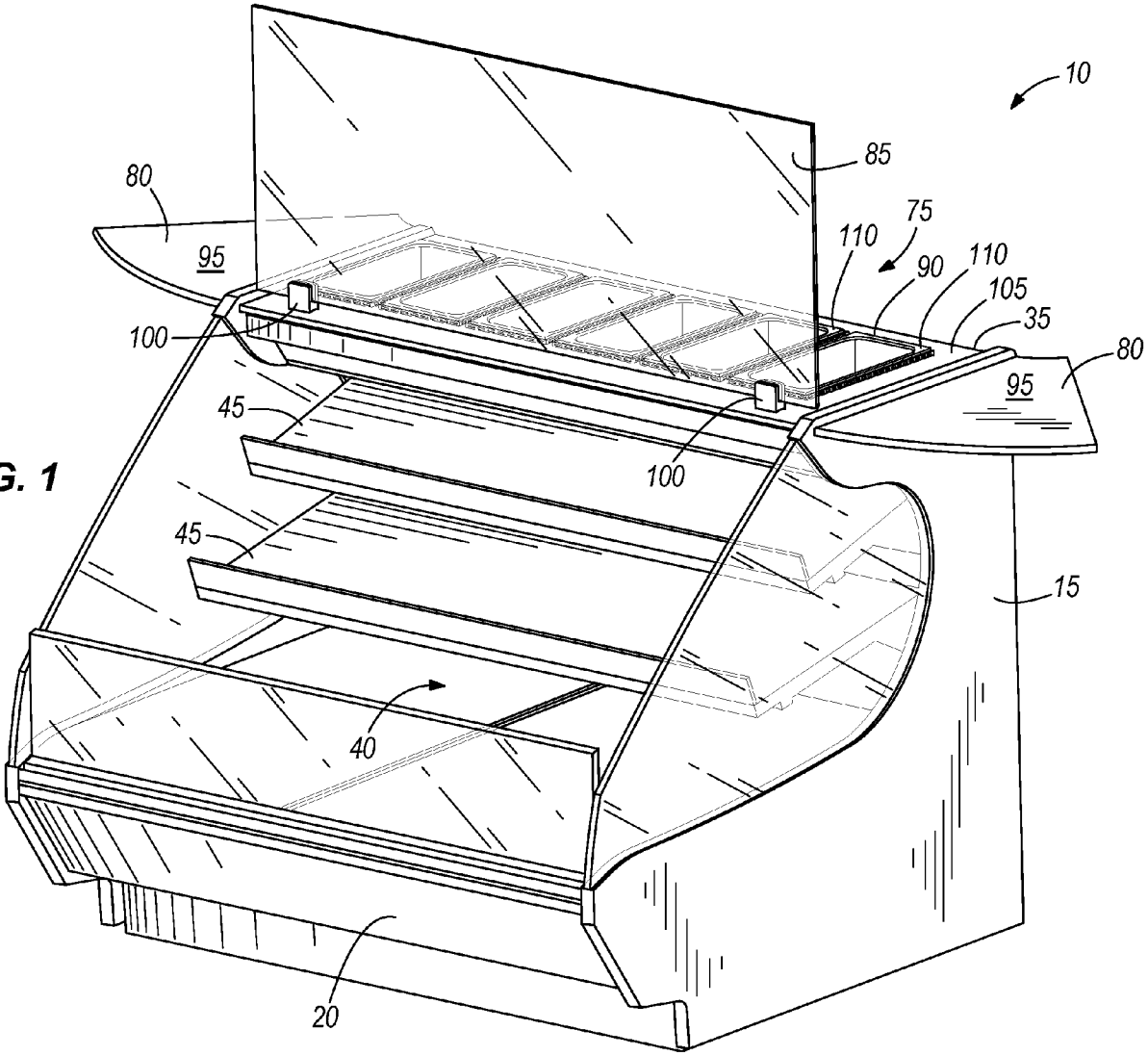
FIG. 1 is a perspective view of an exemplary merchandiser including pans for supporting food product.
Figure 2:
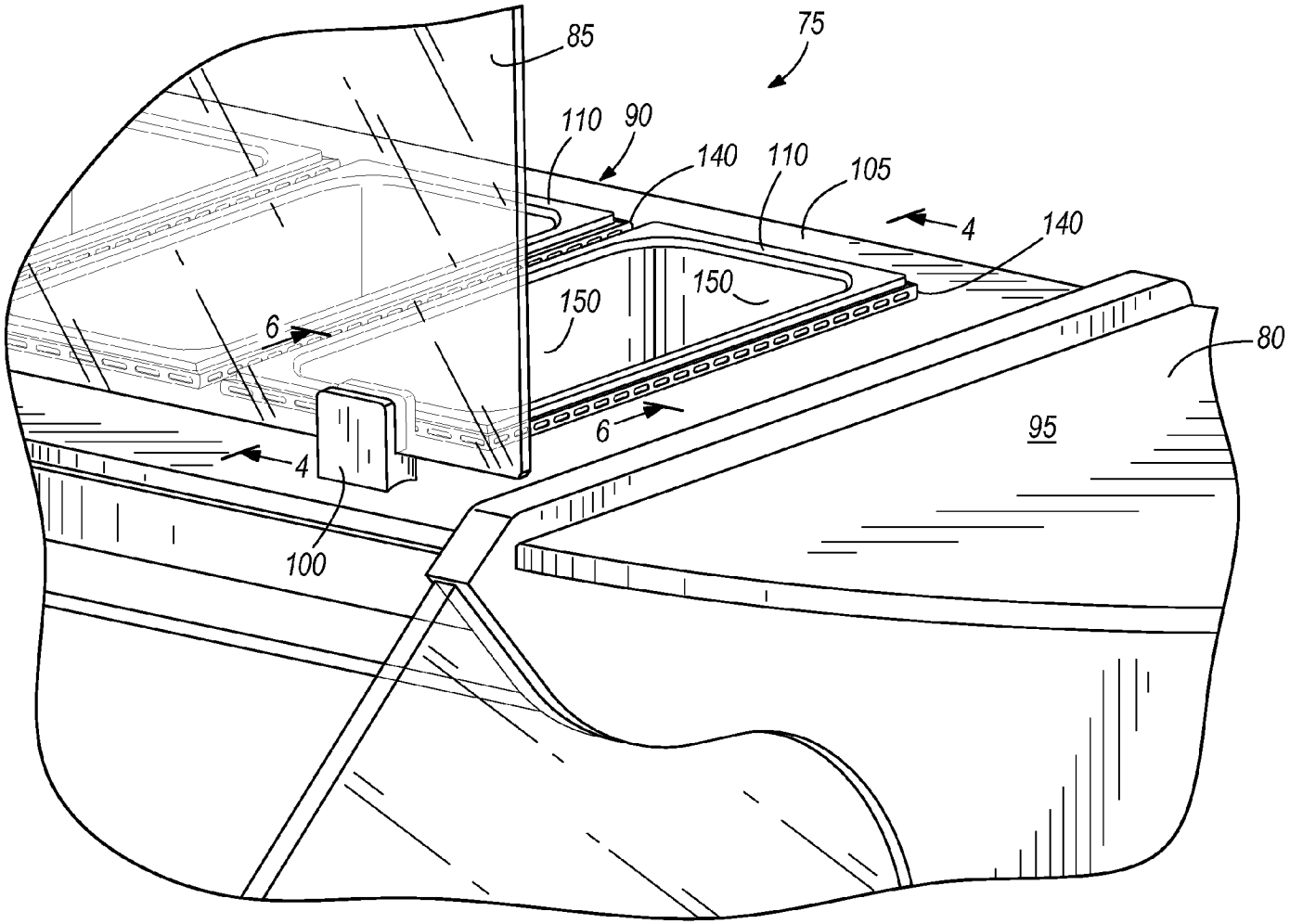
FIG. 2 is a perspective view of a portion of the merchandiser of FIG. 1.
Figure 3:
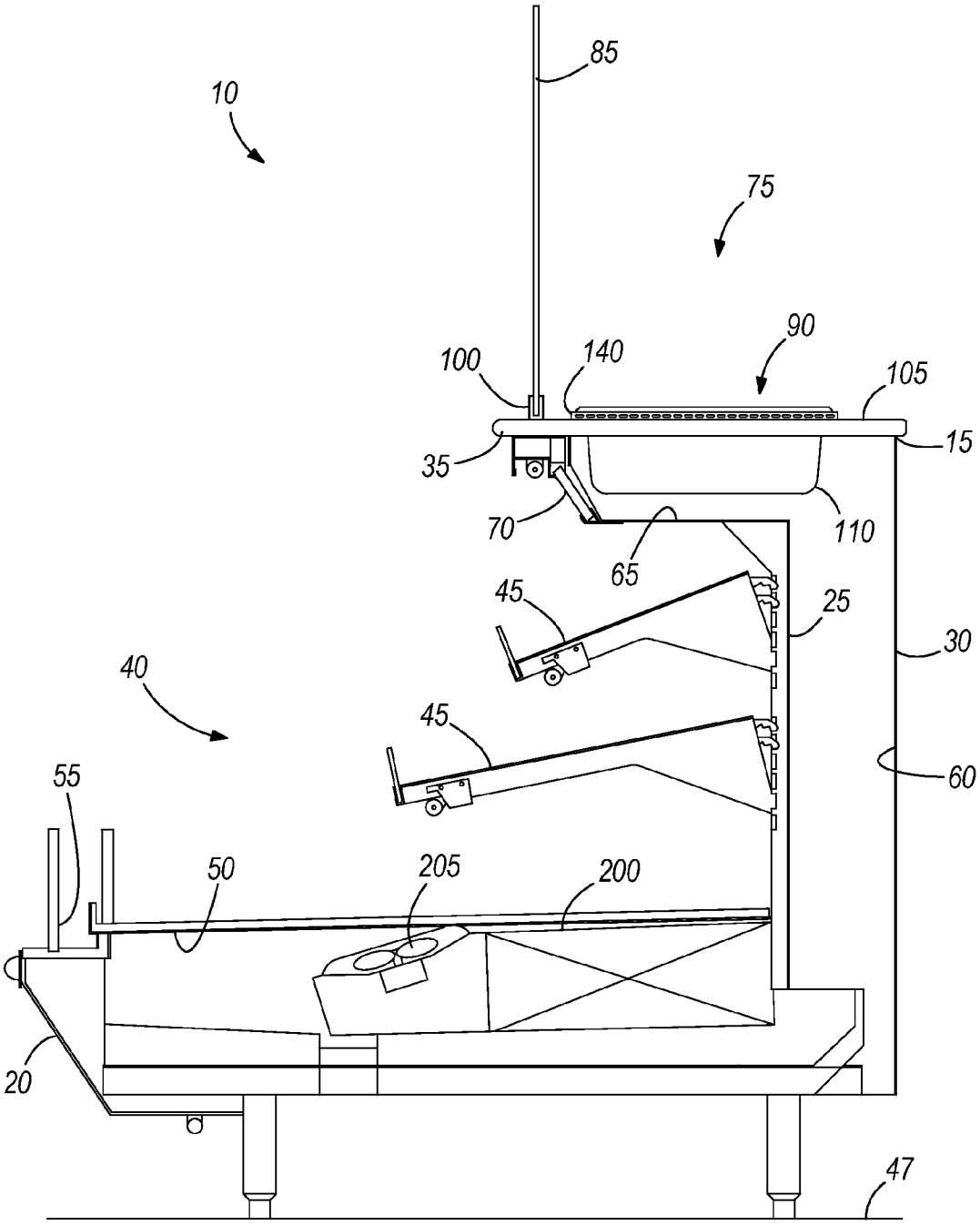
FIG. 3 is a schematic side view of the merchandiser of FIG. 1.

FIGS. 1 and 3 show a merchandiser 10 that may be located in a supermarket or a convenience store (not shown) for presenting fresh food, beverages, and other food product (not shown) to customers. In the illustrated construction, the merchandiser 10 is a self-contained merchandiser, although other merchandisers are also considered herein. The merchandiser 10 includes a case 15 that has a base 20, a rear wall 25, an external wall 30, and a case top 35. The area partially enclosed by the base 20, the rear wall 25, and the case top 35 defines a product display area 40 for supporting and displaying product on shelves 45. The product display area 40 is accessible by customers through an opening adjacent the front of the case 15.

The base 20 is disposed substantially below the product display area 40 and can be supported by a floor or support surface 47 of the supermarket. The base 20 defines a lower portion of the product display area 40 and can support a portion of the food product in the case 15. The base 20 further defines a lower passageway 50 and includes an air inlet 55 positioned between and in communication with the product display area 40 and the lower passageway 50 adjacent the front of the case 15. The rear wall 25 and the external wall 30 cooperate to define a rear passageway 60 that is in communication with the lower passageway 50.

FIGS. 1-4 show that the case top 35 is positioned above the product display area 40 and defines an upper passageway 65 that is in communication with the rear passageway 60. The case top 35 includes an air outlet 70 located adjacent and in communication with the product display area 40 to direct a conditioned airflow into the product display area 40.

The case top 35 also includes a food preparation area 75 that has ledges 80, a glass panel 85, and a condiment area 90. The ledges 80 are coupled to and extend outward from ends of the condiment area 90 to provide work surfaces 95 for preparing and/or supporting food product. The glass panel 85 is coupled to the case top 35 via glass panel supports 100 and are oriented generally vertically to shield the condiment area 90.

The condiment area 90 includes a countertop or platform 105 and a plurality of condiment storage compartments or pans 110 that are coupled to the platform 105 and accessible adjacent the case top 35. In other constructions, the pans 110 can be located in other areas of the case 15 (e.g., the product display area 40).

Figure 4:
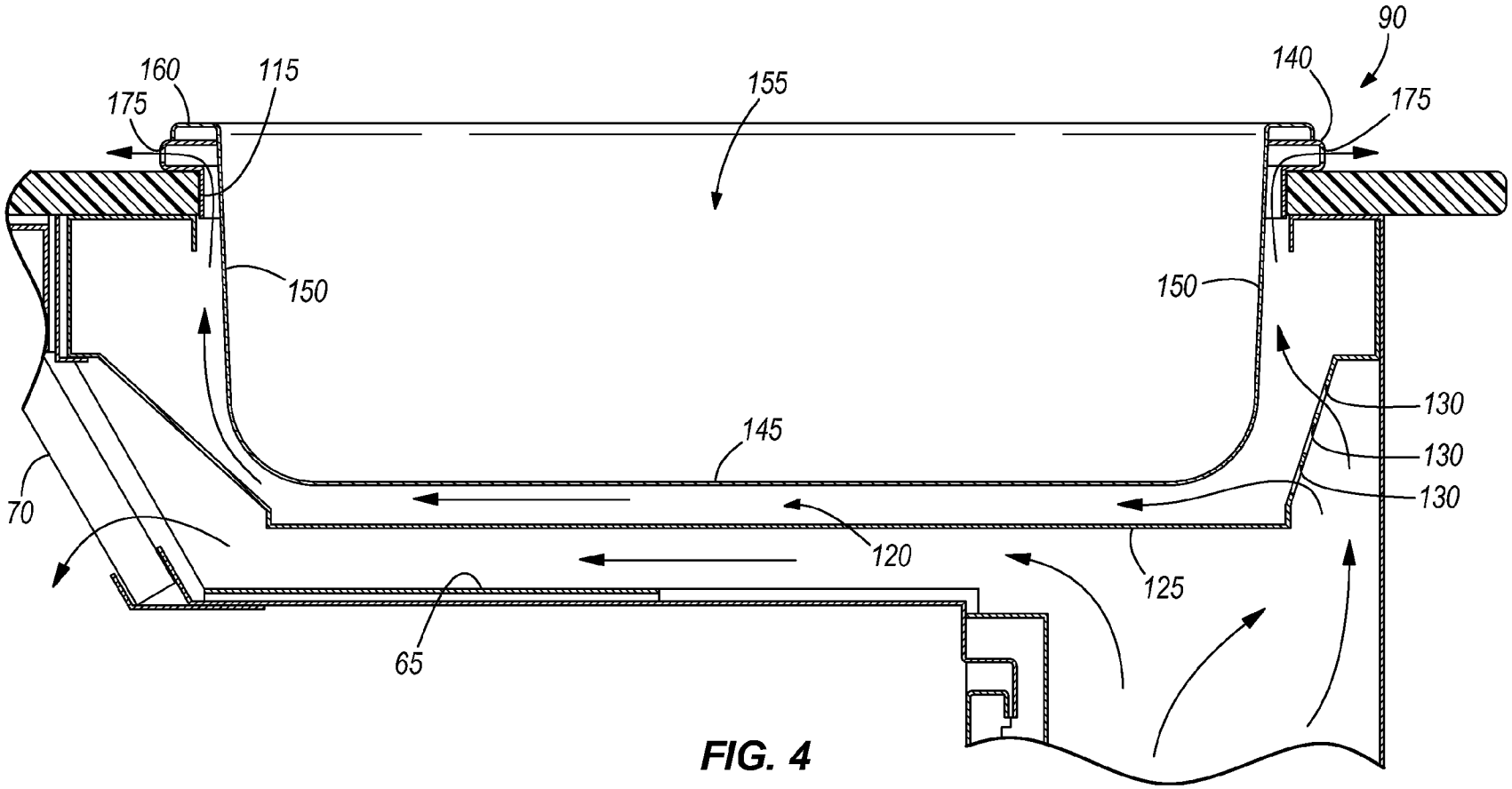
FIG. 4 is a cross-section view of a portion of the merchandiser of FIG. 1 taken along line 4-4 and illustrating one pan and a frame supporting the pan.

The platform 105 extends across the case top 35 and the glass panel supports 100 are coupled to the platform 105 and spaced from each other to support the glass panel 85. FIG. 4 shows that the platform 105 defines a plurality of openings 115 in communication with a storage space 120 that has a dividing wall 125 extending along the length of the platform 105 and defining the bottom of the storage space 120. As illustrated in FIG. 4, the dividing wall 125 separates the storage space 120 from the upper passageway 65 such that the pans 110 and the dividing wall 125 cooperate to define an airflow passageway within the storage space 120. The dividing wall 125 includes one or more apertures 130 adjacent a rear of the case 15 that are in communication with the rear passageway 60. In some constructions, insulation can be coupled to the dividing wall 125.

Generally, one pan 110 is supported in a corresponding opening 115 within the storage space 120. As illustrated in FIG. 1, the condiment area 90 includes six pans 110 supported in six openings 115. In other constructions, the condiment area 90 can include fewer or more than six pans 110 supported in an equal quantity of openings 115.

Figure 6:
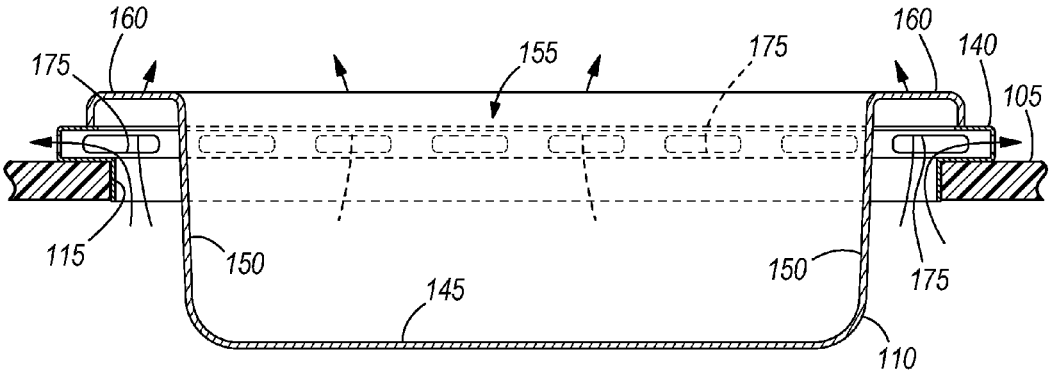
FIG. 6 is a cross-section view of a portion of the merchandiser of FIG. 1 taken along line 6-6 in FIG. 2.

FIGS. 1-4 show that each of the pans 110 is suspended from the platform 105 within the storage space 120, and is supported on the platform 105 by a frame 140. As illustrated in FIGS. 3 and 4, the condiment pans 110 are suspended in the case top 35 in communication with the rear passageway 60 and above the upper passageway 65. FIGS. 3, 4, and 6 show one pan 110 that includes a bottom wall 145, and a plurality of sidewalls 150 cooperating with the bottom wall 145 to define a space 155 for supporting product in the pan 110. The sidewalls 150 include frame engagement members 160 located adjacent a top of the pan 110. In the illustrated construction, the frame engagement member 160 is continuous around the pan 110. In some constructions, fewer than all of the sidewalls 150 may include the frame engagement member 160 (e.g., at least two of the sidewalls 150 may include the frame engagement member 160). Although the illustrated construction shows the pan 110 including four sidewalls 150 defining a substantially rectangular pan 110, other pan shapes (triangular, polygonal, cylindrical, trapezoidal, etc.) are possible and considered herein.

Figure 5:
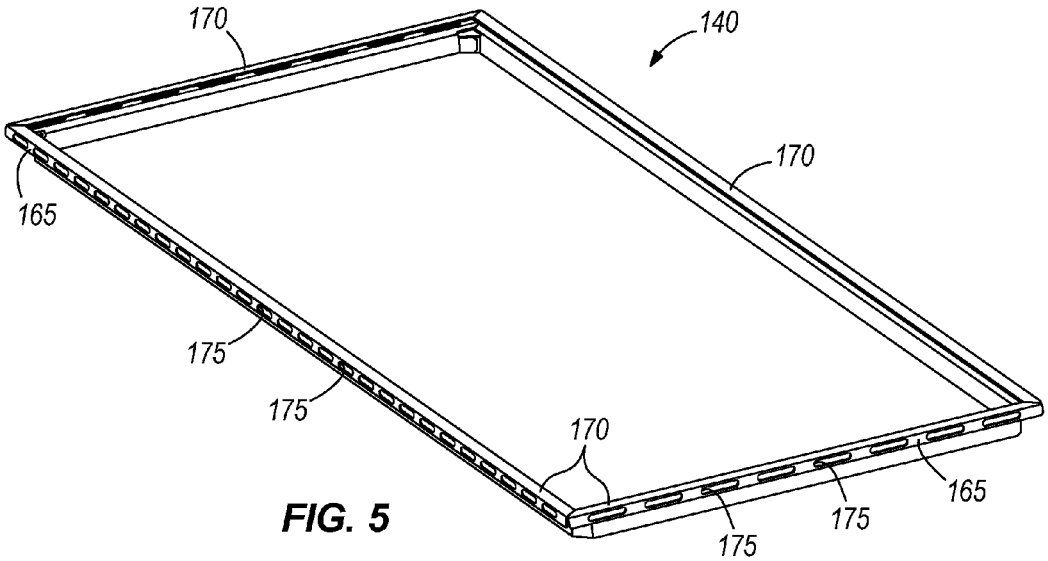
FIG. 5 is a perspective view of the frame of FIG. 4.

As illustrated in FIGS. 5 and 6, the frame 140 is a separate piece that is coupled to the pan 110. In some constructions, the pan 110 and the frame 140 can be welded to each other. In other constructions, the pan 110 and the frame 140 can be attached to each other by fasteners (e.g., rivets, bolts, screws, etc.). In still other constructions, the pan 110 and the frame 140 can be formed as a single piece. The pan 110 and the frame 140 can be formed from any suitable materials, including but not limited to sheet metal, plastic, and composite.

The frame 140 supports the pan 110 via the frame engagement members 160. The frame 140 is defined by a perimeter that engages the platform 105 adjacent the opening 115 to support the pan 110 within the opening 115. Generally, one frame 140 is associated with a corresponding pan 110, and each frame 140 is coupled to a periphery of the opening 115 in which the pan 110 is suspended. In the construction illustrated in FIGS. 5 and 6, the frame 140 is positioned adjacent a top of the sidewalls 150 and extends around the entire upper perimeter of the pan 110. In other constructions, the frame 140 may extend around a portion of the upper perimeter of the pan 110 (e.g., along three sides of the pan 110, along two opposed sides of the pan 110, along two adjacent sides of the pan 110, etc.).

The perimeter of the frame 140 is defined by a first wall 165 and a second wall 170 that is angled relative to the first wall 165. As illustrated in FIGS. 4-6, the first wall 165 is substantially vertically-oriented, and the second wall 170 is substantially horizontally-oriented such that the second wall 170 is oriented at approximately a 90 degree angle relative to the first wall 165.

The frame 140 defines a plurality of air slots or holes 175 that are spaced along the perimeter to direct an airflow from below the pan 110 outward adjacent the perimeter of the pan 110. The holes 175 are spaced along the entire perimeter of the frame 140. In some constructions, the holes 175 can be spaced along a continuous length of the perimeter that is less than the entire perimeter of the frame 140 (e.g., along three sides of the frame 140). In other constructions, the holes 175 can be spaced along different, discontinuous lengths of the perimeter.

Generally, the holes 175 can be oriented on the frame 140 in any manner to achieve the desired airflow (e.g., a vertically-oriented airflow, a horizontally-oriented airflow, a non-vertical, non-horizontal oriented airflow, etc.) upward along the sidewalls 150 of the pan 110 and outward from the frame 140. As shown in FIGS. 4-6, the holes 175 are defined in the first wall 165 such that the airflow through and outward from the frame 140 is substantially horizontal (as viewed in FIGS. 6 and 7).

Figure 7:
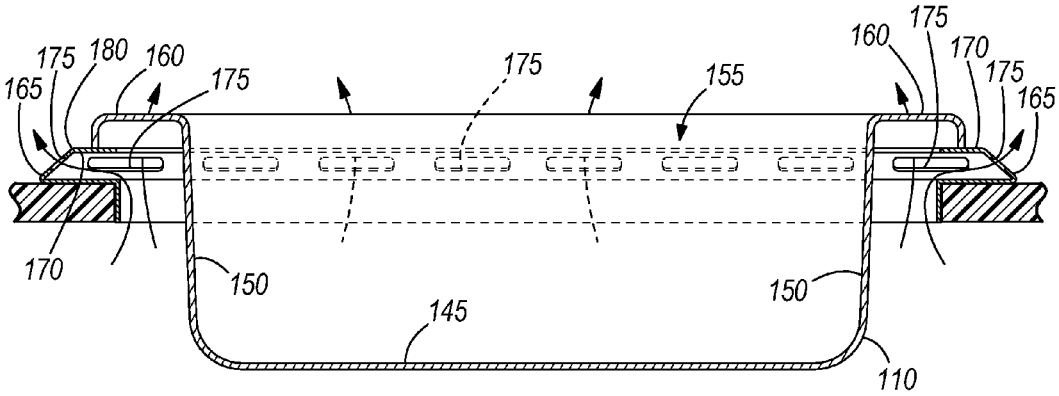
FIG. 7 is a cross-section view of a portion of the merchandiser including the pan and another frame embodying the invention.
Figure 8:
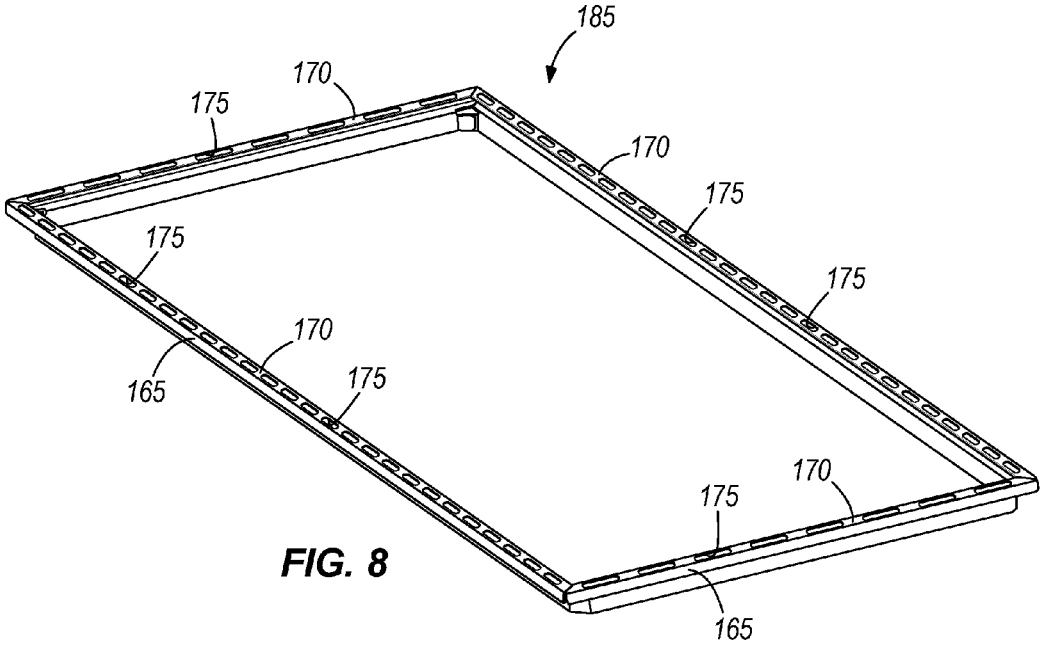
FIG. 8 is a perspective view of another frame for the merchandiser of FIG. 1.

FIG. 7 shows another frame 180 for use with the merchandiser 10. Except as described below, the frame 180 is the same as the frame 140 described with regard to FIGS. 4-6, and like elements are given the same reference numerals. The frame 180 includes the first wall 165 and the second wall 170. In this construction, the second wall 170 is oriented at an angle of approximately 120 degrees relative to the first wall 165. The holes 175 are defined in the angled, non-vertical first wall 165 such that the airflow through and outward from the frame 180 is discharged substantially at a non-horizontal, non-vertical angle (as viewed in FIG. 8). Other angles between the first and second walls 165, 170 also are possible and considered herein.

Figure 9:
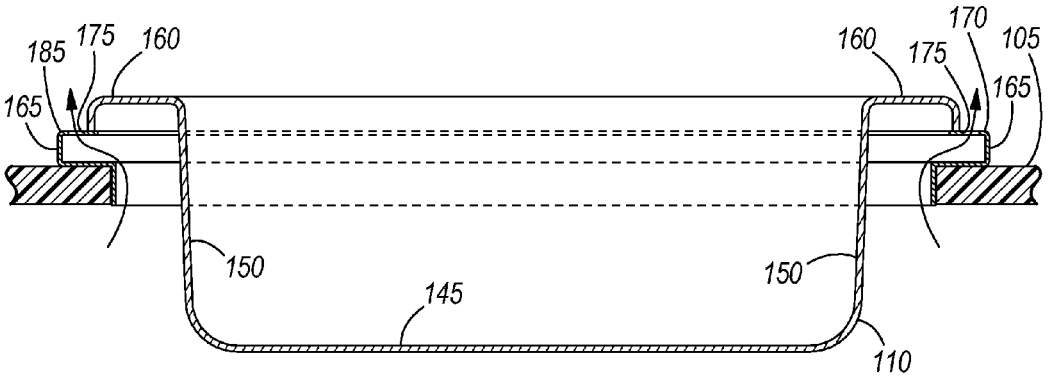
FIG. 9 is a cross-section view of a portion of the merchandiser of FIG. 1 including the frame of FIG. 8.
Figure 10:
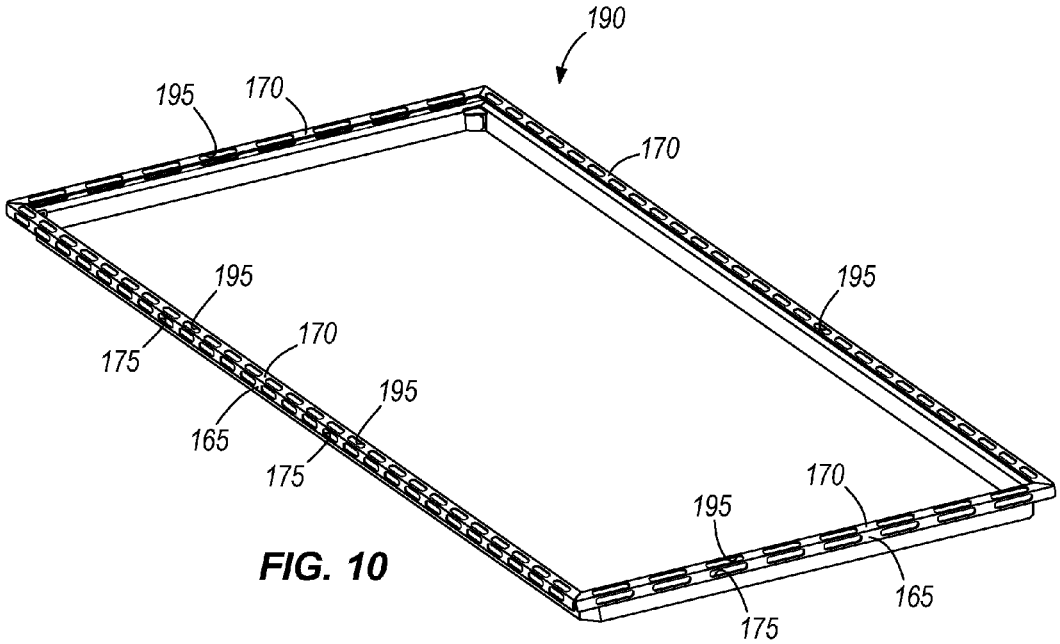
FIG. 10 is a perspective view of another frame for the merchandiser of FIG. 1.

FIGS. 9 and 10 show another frame 185 for use with the merchandiser 10. Except as described below, the frame 185 is the same as the frame 140, and like elements are given the same reference numerals. As illustrated in FIGS. 9 and 10, the holes 175 of the frame 185 are defined in the second wall 170 such that the airflow is directed through and outward from the frame 185 substantially vertically (as viewed in FIG. 10). In this construction, the first wall 165 is without holes.

FIG. 11 shows another frame 190 for use with the merchandiser 10. Except as described below, the frame 190 is the same as the frame 140, and like elements are given the same reference numerals. The frame 190 includes the holes 175 that are defined in the first wall 165, and a second plurality of holes 195 that are defined in the second wall 170. The second holes 195 can be arranged along the perimeter of the frame 190 in any manner suitable to achieve the desired airflow outward from the frame 190 (e.g., continuous along the entire perimeter of the frame 190, along a portion of the perimeter of the frame 190, along different, discontinuous portions of the perimeter of the frame, etc.). In the construction of the frame 190 illustrated in FIG. 11, the airflow is directed substantially horizontally and substantially vertically through and outward from the frame 195.

The illustrated merchandiser 10 further includes at least a portion of a refrigeration system coupled to the case 15 and in communication with the product display area 40 to maintain the product display area 40 within a desired temperature range (e.g., approximately 32 degrees Fahrenheit and 41 degrees Fahrenheit). As illustrated in FIG. 3, the refrigeration system includes an evaporator 200 and one or more air flow generation devices or blowers or fans 205 (shown schematically) positioned in the lower passageway 50 to generate a refrigerated airflow through the lower passageway 50, the rear passageway 60, and the upper passageway 65 to the product display area 40 via the air outlet 70. The fans 205 can be located upstream or downstream of the evaporator 200. In other constructions, the evaporator 200 and/or the fans 205 can be located in the rear passageway 60. The refrigeration system also includes other components, such as one or more compressors, a receiver, and one or more expansion valves (not shown) that can be supported by the case 15 or located remotely from the merchandiser 10. In other constructions, a heating system can be located within the case 15 or located remotely from the merchandiser 10 to heat food product.

The fans 205 induce an airflow through the air inlet 55 from the product display area 40, as well as from adjacent the merchandiser 10. The airflow is conditioned by the evaporator 200 and is directed through the lower passageway 50, the rear passageway 60, and the upper passageway 65 before the airflow is discharged into the product display area 40 via the air outlet 70 to cool product supported in the product display area 40.

As shown in FIG. 3, some of the airflow in the rear passageway 60 flows through the apertures 130 into the storage space 120 below the pans 110. The airflow in the storage space 120 passes below the pans 110 and is directed upward along the sidewalls 150 of the pans 110 and discharged through the frames 140 via the holes 175 to condition the product supported in the pans 110. The airflow upward along the sidewalls 150 and through and outward from each frame 140 conditions the product stored in the corresponding pan 110 by removing at least some of the heat load introduced into the condiment area 90 by the ambient environment.

The pans 110, the dividing wall 125, and the frames 140 surrounding the pans 110 cooperate to direct a portion of the conditioned airflow from the rear passageway 60 around and upward along the pans 110 to remove the heat load introduced from the ambient environment into the pans 110 without using a separate airflow generation device or a separate air conditioning device (e.g., a cooling or heating device) in the condiment area. In other words, a portion of the airflow through the merchandiser 10 flows along the sidewalls 150 of the pans 110 and just below the pan 110 edges via the first holes 175 and/or the second holes 195 so that the pans 110 are sufficiently conditioned by a portion of the airflow from the rear passageway 60 using the primary conditioning means (e.g., the evaporator 200) of the merchandiser 10, which reduces the case volume that is needed to adequately condition the condiment area 90. The airflow is vented outward around at least a portion of each frame 140 and the corresponding pan 110.

Various features and advantages of the invention are set forth in the following claims.

The invention claimed is:

1. A pan apparatus for a merchandiser, the merchandiser including a case having a platform defining an opening, the pan comprising:

a bottom wall;

a plurality of sidewalls cooperating with the bottom wall to define a space for supporting product in the pan, at least two of the sidewalls each including a frame engagement member adjacent a top of the pan; and a frame positioned adjacent a top of the sidewalls and coupled to the frame engagement members, the frame extending along at least three sidewalls of the pan and configured to engage the platform adjacent the opening to suspend the pan within the opening, and the frame having a perimeter and defining a plurality of holes spaced along at least a portion of the perimeter such that an airflow from below the pan is directed upward along the sidewalls and discharged outward through at least three sides of the frame via the holes above a top of the platform to condition the product.

2. The pan apparatus of claim 1, wherein the perimeter of the frame is defined by a first wall and a second wall disposed at an angle relative to the first wall, and wherein the holes are defined in the first wall and configured to direct the airflow away from the space.

3. The pan apparatus of claim 2, wherein the first wall is substantially vertically-oriented.

4. The pan apparatus of claim 2, wherein the second wall is substantially horizontally-oriented.

5. The pan apparatus of claim 1, wherein the perimeter of the frame is defined by a first wall and a second wall disposed at an angle relative to the first wall, and wherein the holes are defined in the second wall and configured to direct the airflow away from the space.

6. The pan apparatus of claim 1, wherein the plurality of holes are spaced along the entire perimeter of the frame.

7. A merchandiser comprising:

a case defining a product display area, a lower passageway in fluid communication with the product display area, and a rear passageway in fluid communication with the lower passageway, the case including a base and a platform positioned above the base, the platform defining an opening accessible from adjacent a top of the case;

a pan suspended from the platform within the opening, the pan defined by a plurality of sidewalls and a bottom wall cooperating with the sidewalls to define a space for supporting product therein; and a frame coupled to the platform adjacent a periphery of the opening, the frame further coupled to the pan adjacent a top of at least three sidewalls to support the pan within the opening, and the frame including a perimeter and defining a plurality of holes spaced along the perimeter such that an airflow from the rear passageway is at least partially directed upward along the sidewalls and discharged outward through at least three sides of the frame via the holes adjacent the top of the pan and above a top of the platform to condition the product.

8. The merchandiser of claim 7, wherein the case further defines an upper passageway in fluid communication with the rear passageway and the product display area, and an airflow passageway in fluid communication with the rear passageway and the holes.

9. The merchandiser of claim 7, wherein the plurality of holes are spaced along the entire perimeter of the frame.

10. The merchandiser of claim 7, further comprising an airflow generation device configured to direct the airflow through the rear passageway.

11. The merchandiser of claim 7, wherein the perimeter of the frame is defined by a first wall and a second wall disposed at an angle relative to the first wall, and wherein the holes are defined in the first wall and configured to direct the airflow away from the space.

12. The merchandiser of claim 11, wherein the first wall is substantially vertically-oriented.

13. The merchandiser of claim 11, wherein the frame further includes a second plurality of holes defined in the second wall.

14. The merchandiser of claim 7, wherein the perimeter of the frame is defined by a first wall and a second wall disposed at an angle relative to the first wall, and wherein the holes are defined in the second wall and configured to direct the airflow away from the space.

* * * * *